US005920945A

United States Patent [19]

Libman

[11] Patent Number: 5,920,945

[45] Date of Patent: Jul. 13, 1999

[54] BROOM HEAD WITH INTEGRAL TERMINAL CONNECTION FOR WINDING WIRE

[76] Inventor: Robert J. Libman, P.O. Box 68, Arcola, Ill. 61910-0068

[21] Appl. No.: 08/893,949

[22] Filed: Jul. 16, 1997

[51] Int. Cl.[6] ..... A46B 3/18

[52] U.S. Cl. ..... 15/207; 15/189

[58] Field of Search ..... 15/159.1, 171, 15/176.1, 189, 207

[56] References Cited

U.S. PATENT DOCUMENTS

| | | | |
|---|---|---|---|
| 223,703 | 1/1880 | Bradt | 15/143.1 |
| 674,899 | 5/1901 | Bradt et al. | 15/189 |
| 984,930 | 2/1911 | Kennedy | 15/206 |
| 1,377,926 | 5/1921 | Ray | 15/206 |
| 1,409,560 | 3/1922 | Manning | 15/171 |
| 1,556,841 | 11/1925 | Keener | 15/189 |
| 3,535,727 | 10/1970 | McCaffray, Jr. | 15/171 |
| 4,064,587 | 12/1977 | Schnabl | 15/175 |
| 4,528,713 | 7/1985 | Libman | 15/171 |

*Primary Examiner*—Mark Spisich
*Assistant Examiner*—Theresa T. Snider
*Attorney, Agent, or Firm*—Marshall, O'Tool, Gerstein, Murray & Borun

[57] ABSTRACT

A detachable broom head is built on a plug having an integral terminal connection for a winding wire. The terminal connection has a stem and a flange, the lowermost segment of the flange being continuous with the lowermost edge of the stem. This allows the windings to be continued all the way to the stem, preventing an undesirable gap in the windings.

10 Claims, 3 Drawing Sheets

BROOM HEAD WITH INTEGRAL TERMINAL CONNECTION FOR WINDING WIRE

CROSS-REFERENCE TO RELATED APPLICATIONS

Not applicable.

STATEMENT REGARDING FEDERALLY-SPONSORED RESEARCH OR DEVELOPMENT

Not applicable.

BACKGROUND OF THE INVENTION

For many years, people have made brooms by attaching fibers to one end of a handle. Conventionally, the fibers (traditionally broom corn fibers) are attached to the handle in a winding operation in which the handle is mounted in a chuck that rotates the handle while fiber is fed onto the handle. The fiber is retained on the handle by a winding wire that wraps around fibers as the handle is rotated. After the winding is completed, a nail is driven into the handle next to the last winding. The nail is driven into the handle so its stem is directly adjacent to the last winding, and thus helps to maintain tight windings. The wire is then wrapped around the stem of the nail to secure the wire in place, thus tying the broom fibers to the handle.

One problem faced by large-scale broom manufacturers is that the compound shape of a broom (a broad head joined to a long, narrow handle) makes it difficult to efficiently pack a bulk load. To address this problem, broom manufacturers have begun making brooms with separate, detachable heads, allowing the heads and handles to be packed separately, and thus more efficiently. However, detachable heads are generally more expensive to produce than the heads of traditional wound brooms.

At least one broom manufacturer has tried to reduce the cost of detachable heads through an adoption of conventional winding technology. The heads have been made by wrapping broom fibers around a small plug that could be fastened to a handle at the point of sale. To avoid the need for driving a nail into the plug after the winding is completed, the plug has been provided with an integrally-molded nail that served as a terminal connection for the winding wire. One problem with substituting a molded nail for a nail driven into a broom handle after the winding is completed has been that the head of the molded nail (which is necessary to prevent the wire from slipping off the nail) has interfered with the winding operation by creating a limit on the extent of the windings. Since the head on the molded nail extends beyond the stem, it prevents the windings from being continued all the way up the plug to the stem. The resulting space between the stem of a molded nail and the last winding not only has prevented the nail from helping to maintain the tightest possible windings, but has also promoted an undesireable gap in the windings.

What is needed is a better way to utilize established winding technology in the manufacture of a detachable broom head.

BRIEF SUMMARY OF THE INVENTION

The applicant has developed a detachable broom head that can be made using the conventional winding process without encouraging loose windings.

As is conventionally known, the head includes a central plug with an outer surface upon which broom fibers can be wrapped. It also includes a central opening for receiving a broom handle. A set of bristles is disposed around the outer surface of the plug, and is secured in place by a set of wire windings.

The head differs from conventional broom heads in its terminal connection for the windings. The terminal connection extends integrally from the plug and has two parts: a stem extending from the outer surface of the plug and a flange extending laterally outwardly from the stem. The flange extends above portions of the plug uncovered by windings, but does not extend above the windings. This limit on the extent of the flange allows the windings to be wound around the plug all the way to the stem, as a result of which the stem helps to maintain tight windings.

BRIEF DESCRIPTION OF THE DRAWINGS

The invention can be better understood by reference to the accompanying drawings, in which.

DETAILED DESCRIPTION OF THE INVENTION

Figure 1:
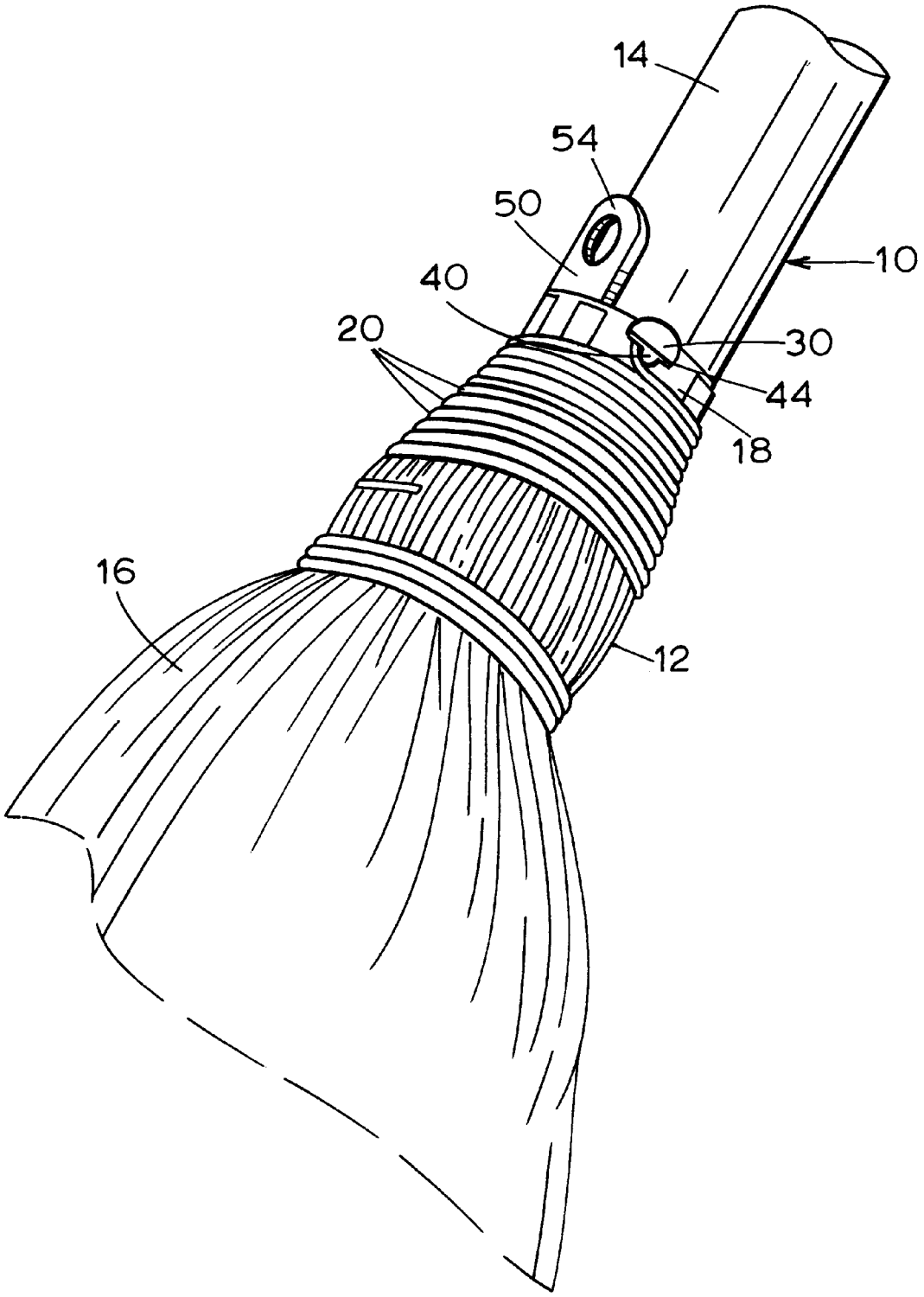
FIG. 1 is a fragmentary perspective view of a broom having a broom head in accordance with the present invention.

FIG. 1 shows a broom 10 with a detachable broom head 12. The broom head is attached to a handle 14, and carries a set of bristles 16. The set of bristles is held in place on a plug 18 by a set of wire windings 20.

The plug 18, seen best in FIGS. 3–6, is preferably molded of plastic, but could also be made of metal or any other suitable material. It includes a central opening 22 (FIGS. 5 and 6), an outer surface 24, a wire base point 26, and a terminal connection 30.

The central opening 22 accommodates the handle 14 (FIG. 1). The plug 18 and handle can be secured in any conventional way, such as gluing, stapling, or threading. As illustrated, the plug has internal thread segments 32 (FIG. 5) that can mate with external threads on the end of a broom handle.

To make the broom head, the plug 18 is first placed in a conventional broom-winding chuck. As illustrated, the plug has four thickened walls 36 (FIG. 6) defining a squarish opening 38 in the bottom of the plug. The squarish opening provides a working surface allowing the plug to be rotated in a conventional chuck by using a square-ended adapter.

Figure 4:
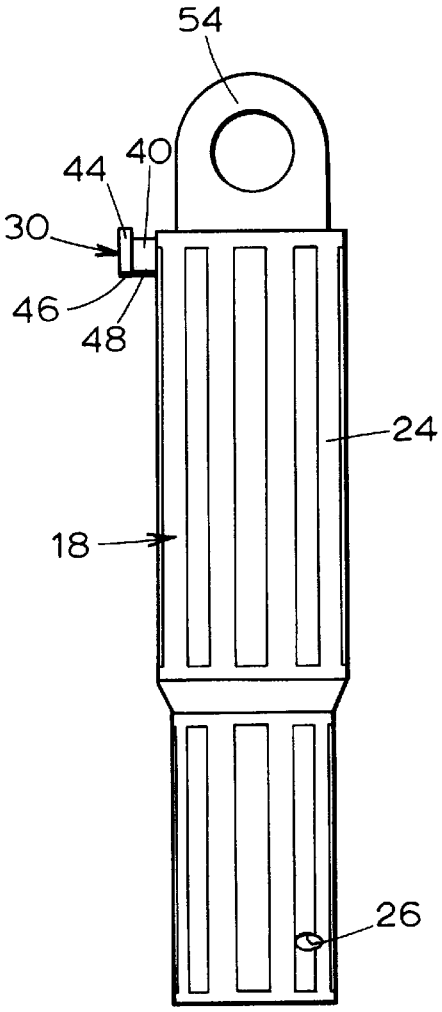
Figure 5:
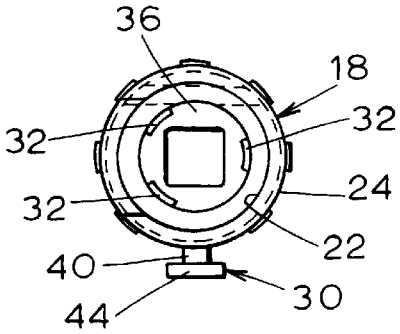
FIG. 5 is a top view of the plug of FIG. 3.
Figure 6:
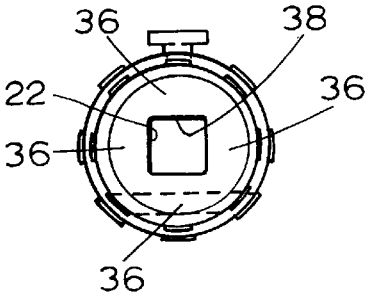
FIG. 6 is a bottom view of the plug of FIG. 3.

After the plug 18 is mounted in the chuck, the end of a winding wire is installed at the base point 26 (FIG. 4). Any type of conventional base point can be provided. As illustrated, the base point is a through aperture in the plug, which passes through one of the thickened walls 36 (FIG. 6).

Once a winding wire is installed, the set of bristles 16 (FIG. 1) are disposed around the outer surface 24 of the plug. The bristles are preferably made of broom corn, but could also be made of any other broom fiber material. Upon rotating the broom head in the chuck, a set of wire windings 20 is wound around the set of bristles to secure them to the broom head. The wire windings 20 continue all the way up to and abut a stem 40 on the terminal connection 30, which extends integrally from the outer surface 24 of the plug 18.

Figure 2:
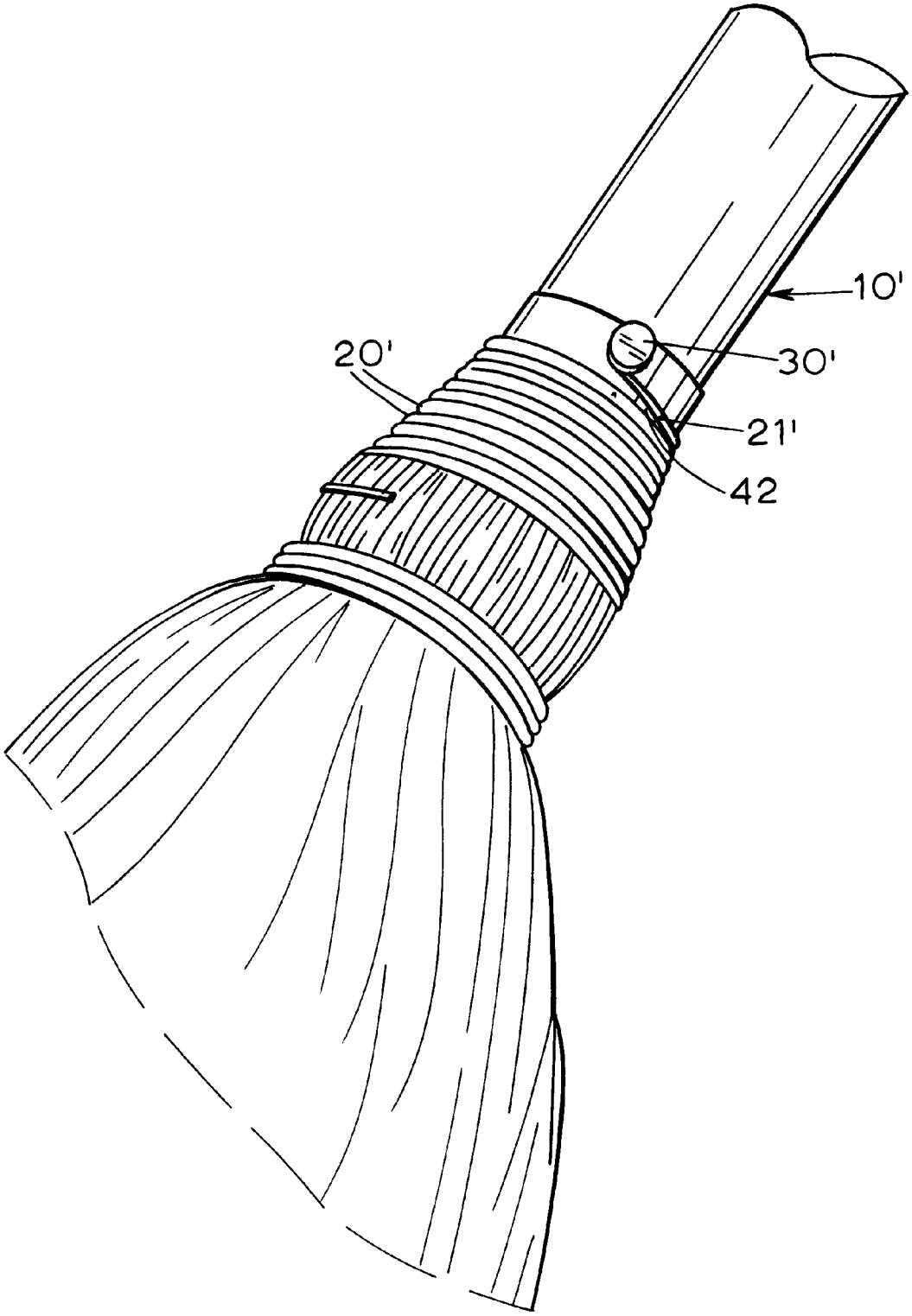
FIG. 2 PRIOR ART
FIG. 2 is a fragmentary perspective view of a prior art broom head with a conventional molded nail.
Figure 3:
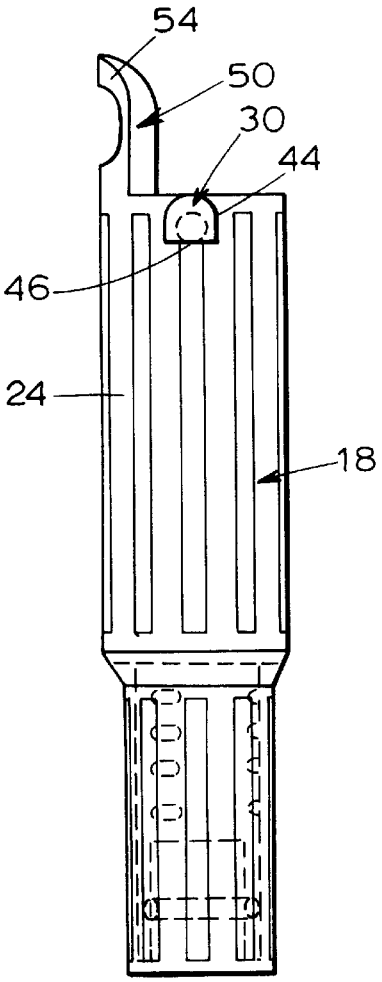
FIGS. 3 and 4 are enlarged side views of the plug used in the broom head of FIG. 1.

In contrast, the windings 20' on a prior art broom 10', shown in FIG. 2, must be stopped short of the stem on a molded nail 30' because of interference from the head on the molded nail. As a result, a final winding 21' on the prior art broom must be separated from the other windings, leaving a gap 42. The existence of this gap may tend to loosen the windings overtime.

The terminal connection 30 of the present invention includes a flange 44 spaced from the outer surface 24 of the plug 18. The flange extends laterally outwardly from the stem 40 above portions of the plug that remain uncovered by windings, but does not extend laterally above the windings 20. Instead, as seen in FIG. 4, a radial lowermost segment 46 on the flange is colinear with a lowermost edge 48 of the stem. The resulting alignment of a lowermost segment of the flange with a lowermost edge of the stem is preferred for allowing the windings to be continued all the way to the stem while maintaining the greatest strength and flange coverage. Alternatively, however, benefits of the invention can be achieved so long as the lowermost segment on the flange forms an angle,$\alpha$, of 180° or greater with the lowermost edge of the stem. As illustrated, the lowermost segment of the flange lies on a planar face that extends perpendicularly to the axis of the plug. Benefits of the invention can also be achieved if the lowermost segment lies on a continuous or segmented convex face, rather than a planar face.

The wire windings 20 are terminated by wrapping the wire around the stem 40 and removing any excess wire. The flange 44 prevents the wire from slipping off the stem. In order to facilitate wrapping and provide sufficient strength to a plastic terminal connection, it is preferable that the stem have a diameter of at least about ¼ inch. Where the flange extends beyond the stem, it preferably extends at least about 1/16th of an inch, and is preferably spaced approximately ⅛ of an inch above the outer surface 24 of the plug.

As illustrated, the plug also includes a hanger 50 with an arm 54 that can be used to hang the broom head from a nail or peg for display surfaces. As illustrated, the arm forms an ornamental circular aperture. This design of the arm was developed for ornamental, rather than functional reasons. Obviously, the arm need not create an aperture to serve its intended purpose, or have the disclosed circular appearance.

This has been principally a description of one product embodying the invention. Those skilled in the art will appreciate that many modifications can be made to the product without departing from the spirit or scope of the invention, which is set forth in the following claims.

What is claimed is:

1. A head for a broom comprising:

a plug with an outer surface and a central opening for receiving a handle;

a set of bristles disposed around the outer surface of the plug;

a set of wire windings wound around the set of bristles; and a terminal connection for the windings extending integrally from the plug and having a stem abutting a terminal edge of the windings and a flange spaced from the outer surface of the plug;

the flange having a lowermost segment that forms an angle of 180° or greater with a lowermost edge of the stem.

2. A broom head as recited in claim 1, and further comprising a wire base point comprised of an aperture through the plug.

3. A broom head as recited in claim 1, and further comprising an integral hanging arm above the stem.

4. A broom head as recited in claim 1, in which the lowermost segment of the flange is co-linear with the lowermost edge of the stem.

5. A broom head as recited in claim 1, in which the flange has a planar lowermost edge that extends perpendicularly to the axis of the plug.

6. A broom comprising:

a handle;

a plug with an outer surface and a central opening for receiving the handle;

a set of bristles disposed around the outer surface of the plug;

a set of wire windings wound around the set of bristles; and a terminal connection for the windings extending integrally from the plug and having a stem abutting a terminal edge of the windings and a flange spaced from the outer surface of the plug;

the flange having a lowermost segment that forms a an angle of 180° or greater with a lowermost edge of the stem.

7. A broom as recited in claim 6, wherein the plug has a wire base point comprised of an aperture through the plug.

8. A broom as recited in claim 6, in which the lowermost segment of the flange is co-linear with the lowermost edge of the stem.

9. A broom as recited in claim 6, in which the flange has a planar lowermost edge that extends perpendicularly to the axis of the broom.

10. A broom comprising:

a handle;

a plug with an outer surface and a central opening for receiving the handle;

a set of bristles disposed around the outer surface of the plug;

a set of windings wound around the set of bristles; and a terminal connection for the windings extending integrally from the plug and having a stem abutting a terminal edge of the windings and a flange spaced from the outer surface of the plug, the lowermost segment of the flange being no lower than the lowermost edge of the stem.

* * * * *